US006976612B1

(12) United States Patent
Miller

(10) Patent No.: US 6,976,612 B1
(45) Date of Patent: Dec. 20, 2005

(54) METHOD OF MANUFACTURING A FUR HAT USING TAIL FUR

(76) Inventor: Armin Miller, 72 Morton St., New York, NY (US) 11211

( * ) Notice: Subject to any disclaimer, the term of this patent is extended or adjusted under 35 U.S.C. 154(b) by 0 days.

(21) Appl. No.: 10/981,198

(22) Filed: Nov. 4, 2004

Related U.S. Application Data

(60) Provisional application No. 60/550,010, filed on Mar. 4, 2004.

(51) Int. Cl.[7] ..... A42C 1/00
(52) U.S. Cl. ..... 223/7; 223/24; 2/182.6; 2/200.1
(58) Field of Search ..... 223/7, 8, 12, 22, 223/24–26; 69/22; 2/182.6, 184, 175.9, 200.1

(56) References Cited

U.S. PATENT DOCUMENTS 2,039,911 A * 5/1936 Lee ..... 2/175.9
2,196,273 A 4/1940 Schatz
3,276,039 A * 10/1966 Lish ..... 2/183
5,581,814 A 12/1996 Ettinger
6,058,511 A * 5/2000 Finch ..... 2/200.1
6,748,632 B2 * 6/2004 Nakai ..... 28/100

* cited by examiner

*Primary Examiner*—Gary L. Welch
(74) *Attorney, Agent, or Firm*—Cohen, Pontani, Lieberman & Pavane

(57) ABSTRACT

A method of making a fur plate includes cutting lengthwise at least one elongate animal tail skin having fur to form a plurality of split tail pieces, and cutting at least one of the split tail pieces to form a plurality of short tail pieces. A plate backing material form is provided by a tongue of backing material having a pair of sides which form a long dimension, and a pair of ends which form a short dimension, the ends comprising a proximal end and a distal end. A split tail piece is attached to the tongue along each of the sides and layers of short tail pieces are attached to the tongue adjacent to the distal end. To make a hat, a plurality of fur plates are attached to the crown of a hat shell by attaching the proximal ends of the tongues to the crown so that the tongues overlap and form a ring bounded by the fur on the sides.

36 Claims, 7 Drawing Sheets

METHOD OF MANUFACTURING A FUR HAT USING TAIL FUR

CROSS-REFERENCE TO RELATED APPLICATIONS

This application claims priority under 35 USC 119(e) from U.S. provisional application number 60/550,010 filed on Mar. 4, 2004.

BACKGROUND OF THE INVENTION

1. Field of the Invention

This invention relates to a high quality natural fur hat made of fur plate segments and a method of manufacturing the fur plates of short tails and small pieces of fur.

2. Description of the Related Art

The present invention is directed at manufacture of natural fur articles. The process was developed in conjunction with making fur plates for a fur hat but is adaptable to a variety of fur articles. The natural fur hat of the present invention, often called a streimel (also spelled shtreimel), has been and continues to be a popular article of clothing among some groups in many areas of the world. The hat is traditionally made of animal tails, and fine quality streimels are currently made from the tails of sable, marten, fisher, and other fur bearing animals.

The use of fur bearing animal tails for clothing is very limited as the tails are not long enough for most garments. Some methods for modifying the tail to make it longer have been proposed. U.S. Pat. No. 2,196,273 (Schatz) describes a method of slitting the tail lengthwise, flattening it and then cutting it into narrow pieces of slit fur which are then alternately sewn together with flexible material in the same order in which the slit fur pieces are removed. This forms a longer piece of alternating fur and bald pieces that may be used in some clothing.

In making a fine quality streimel the tails are traditionally assembled around the periphery of the hat crown in the vertical direction as opposed to the horizontal direction. The design has a long tradition and has evolved from a traditional array of thirteen animal tails, often with alternating fur colors, to a series of thick, flat, uniform color, fur panels, called plates, which cover the hat periphery and employ many more tails than the traditional thirteen, typically on the order of thirty-six. Today's fine quality streimel is constructed such that the fur panel appears to be a seamless continuous piece of fur. This seamless appearance is provided by constructing the plates of a stiff, but moldable, form to which, in the prior art, the entire fur tail is glued or sewn around the edges of the form.

Traditionally the streimel plate forms were made of parchment that had been treated with glue to make them stiff. Now a flexible heat resistant plastic is used, such as Nomex®. A plastic stiffener is inserted into a pouch sewn to the plate form to maintain the shape of the plate. Also, a ribbon of material is sewn or glued to the plate form. This ribbon is the means of attaching the plates around the circumference of the hat crown by sewing them sequentially together by the ribbons to form a circle of plates, or sewing them to a length of ribbon which is then attached end to end to form the circle of plates, so that the circle of plates is the size of the circumference of the hat. The order of assembly of the hat is to first cover the outside of the hat crown, generally with a felt material. Then the lining is installed. Finally the circle of fur plates is attached. A complete hat is then shaped and molded by heating the hat and bending the plate stiffeners when hot. The plate stiffeners are bent into a curve so the plates lie against each other, back to front, with only the fur on the plate periphery showing. Trimming, dying, final cleaning, and final shaping of the finished hat completes the process. A completed fine quality streimel has the fur plates so skillfully shaped that the hat appears to be made of a solid piece of fur.

The fur tails are processed prior to attachment to the plate form to provide the desired density and length of fur. In the prior art this processing involves increasing the fur density by first cutting the tail lengthwise and flattening it, then pleating a tail in the long direction using a process called nailing. Nailing involves wetting the tail skin to make it pliable and mounting the wet skin with nails onto a board in a pleated configuration. The skin is then dried and the finished, pleated tail is removed from the board for installation on the plate form. Installation on the form often requires the tail to be further shaped by slitting and sewing material into the skin and trimming the tail to obtain a shape that will result in the desired configuration.

The process of pleating the tails, shaping them, and installing them on the plate form is labor intensive. It also involves wasted material in the trimmings from the tails as they are assembled on the plates. What is needed is a method of processing the tails to obtain properly shaped fur plates with less labor and waste.

Streimel hats made of artificial materials are also available, as described in U.S. Pat. No. 5,581,814 (Ettinger). The artificial fur is formed into stiffened artificial pelts of a pre-determined shape that are installed on the hat crown through slots in the crown. The artificial streimel therefore cannot be significantly shaped following assembly and the resulting hat is easily identified as of lower quality.

SUMMARY OF THE INVENTION

The present invention is a method of manufacturing a fine quality streimel hat or other fur article with a fur band or panel produced from fur bearing animal tails arranged into moldable plates, and the fur plate, or entire fur article, made with this method. The tails are first split lengthwise and flattened making a split tail. Depending on tail size, they then may be split lengthwise again, resulting in two strips of tail material. One or more resulting strips of tail material is then softened by drawing the skin over the edge of a metal bar repeatedly. This tail material is then cut into small pieces of skin with fur attached. The remaining animal split tails are then applied to a backing material, and the small fur pieces are used to fill the space needed to produce a completed fur plate.

The backing material is typically a flexible heat resistant plastic cut into a form for the fur plate. The plate form is in the shape of an irregular rectangle and sized and configured to provide a fur plate of the desired shape and size. A retaining pocket for a thin stiffener is attached to the long dimension of the form. This houses a long thin piece of stiff plastic in the finished plate. Also a flexible piece of fabric is attached to one of the shorter sides of the plate form rectangle. This is used to attach the completed fur plate to the hat.

Adhesive is applied to one long side of the plate form. A strip of split tail material, or two strips if the tail is very short, is attached to the adhesive by the skin of the split tail. Adhesive is then applied to the other long side of the plate form and a second strip of split tail material is applied. An individual small piece of skin with fur attached is assembled on the plate backing material form near the edge of one short side of the plate form by applying a drop of adhesive to the backing material and placing the skin of the small piece in the glue. This assembly is repeated until the fur is arranged on the backing material form in the desired arrangement to obtain the desired fur density to complete the plate. The fur is combed as needed to produce the desired orientation. Finishing of the hat requires heating and bending the plate stiffeners as needed to obtain the desired shape.

One object of this invention is to reduce the labor required to produce a fine quality streimel fur hat.

A second object of this invention is to reduce the fur wasted in the production of a fine quality streimel fur hat.

A third object of this invention is to produce a fur article from fur bearing animal tails that were not previously used, such as fox, badger, kolinsky sable, and raccoon.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following figures, the representation of fur is intended to show the construction and is not intended to depict the quality of the actual fur.

DETAILED DESCRIPTION OF THE PRESENTLY PREFERRED EMBODIMENTS

Figure 1:
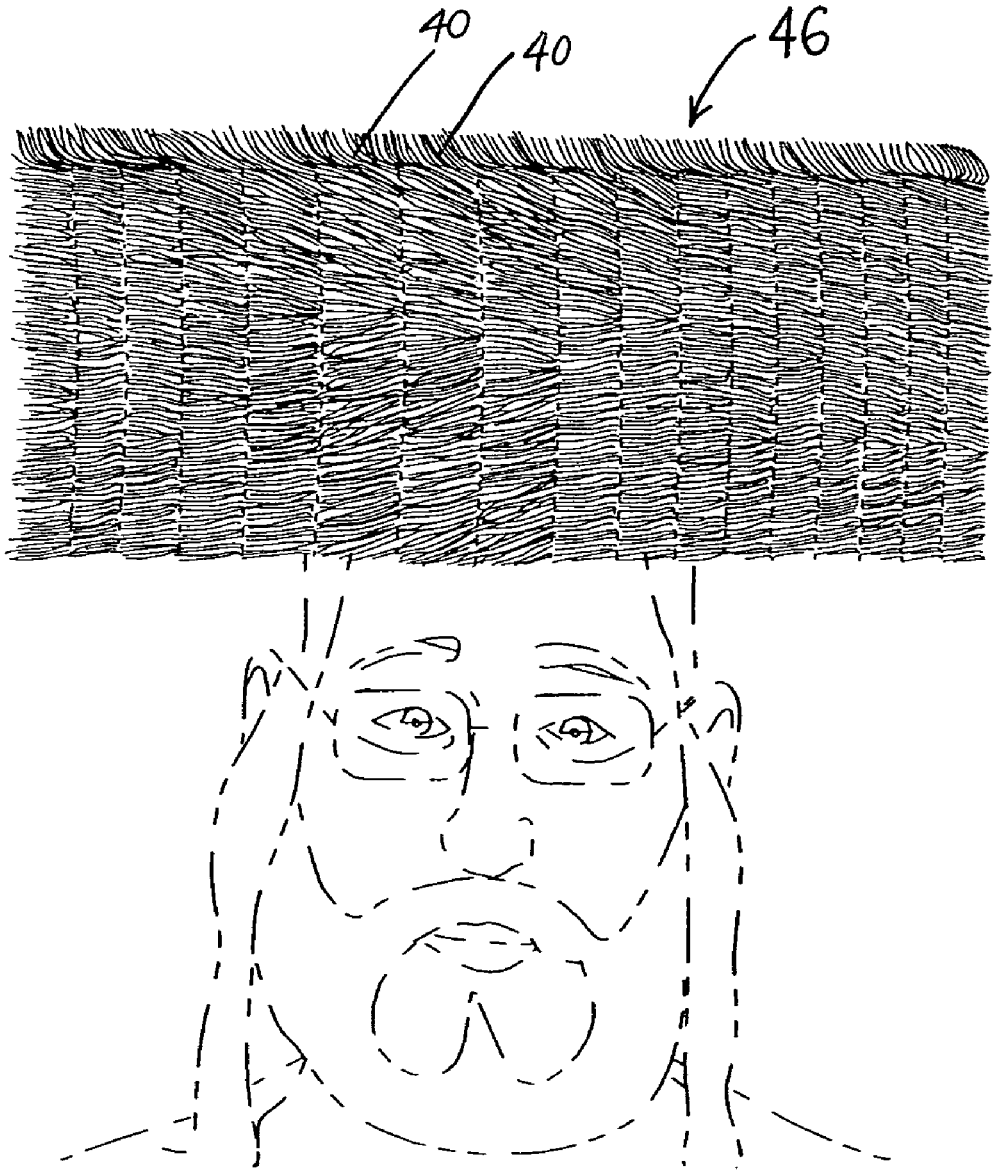
FIG. 1 is a side view of a streimel hat showing the array of fur plates.
Figure 2:
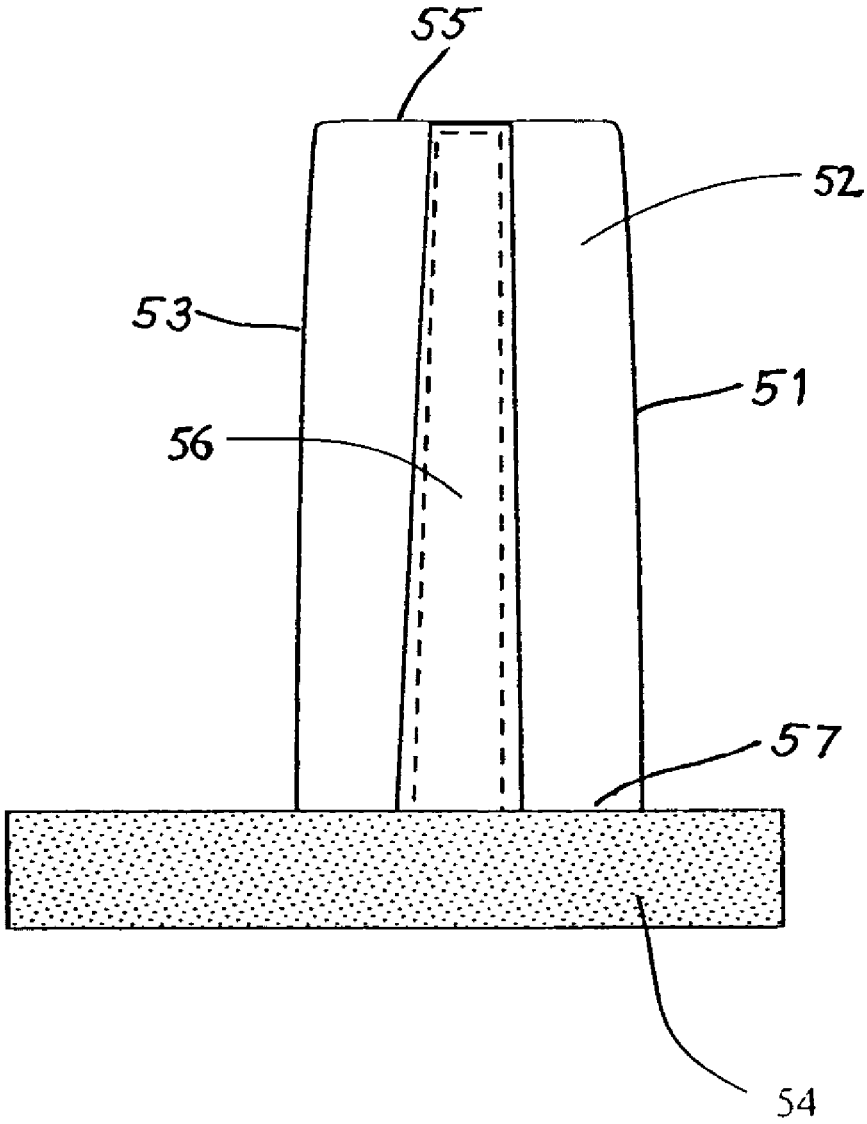
FIG. 2 is a plan view of the fur plate backing material form.
Figure 3:
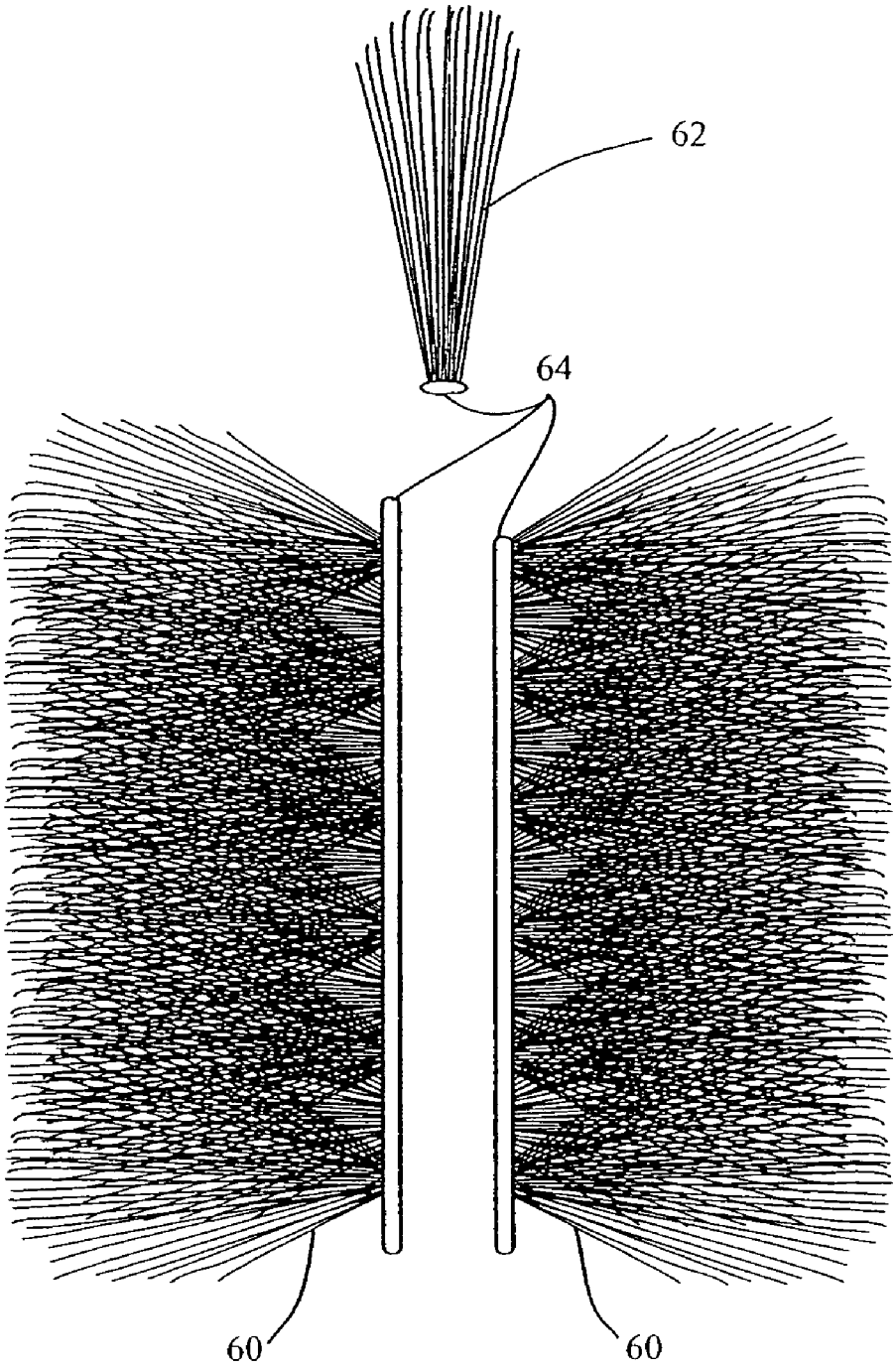
FIG. 3 is a plan view of the fur-bearing animal tail cut in half lengthwise, and a small fur piece removed from one half of the tail.
Figure 4:
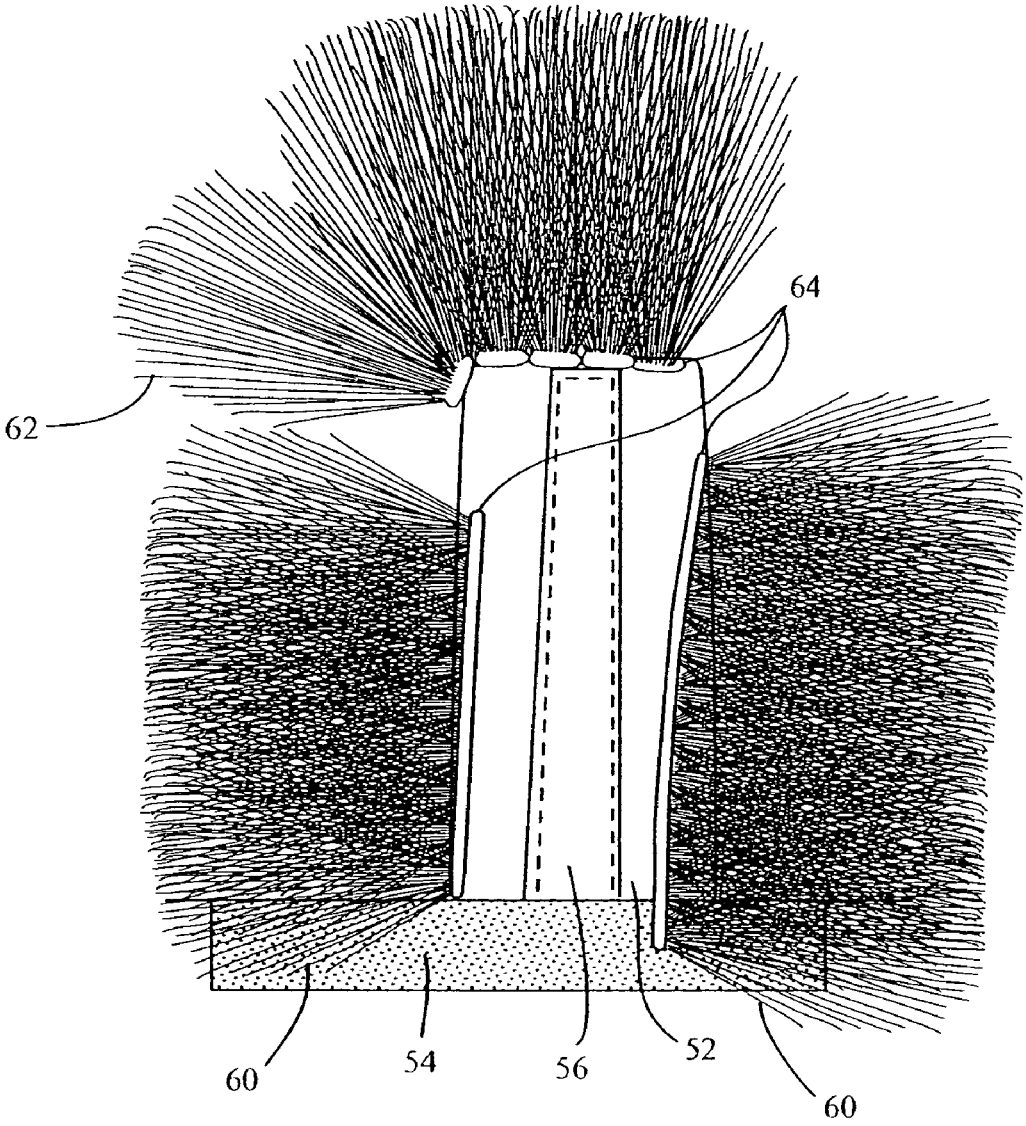
FIG. 4 is a plan view of the fur plate backing material form showing a partially assembled fur plate with individual split tails and small fur pieces assembled on the periphery of the form in the first layer of the assembly.
Figure 5:
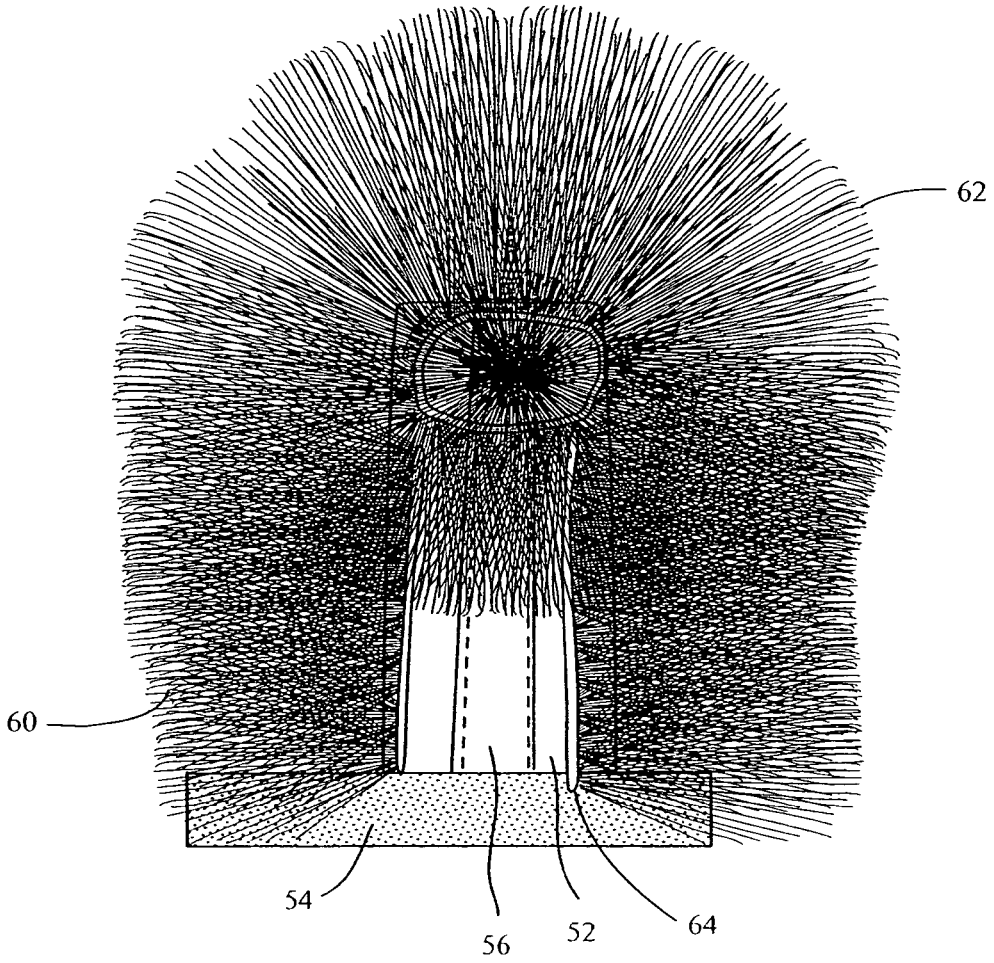
FIG. 5 is a plan view of the fur plate backing material form showing an assembled fur plate with individual split tails and small fur pieces assembled on the form in layers 1 through 3.
Figure 6:
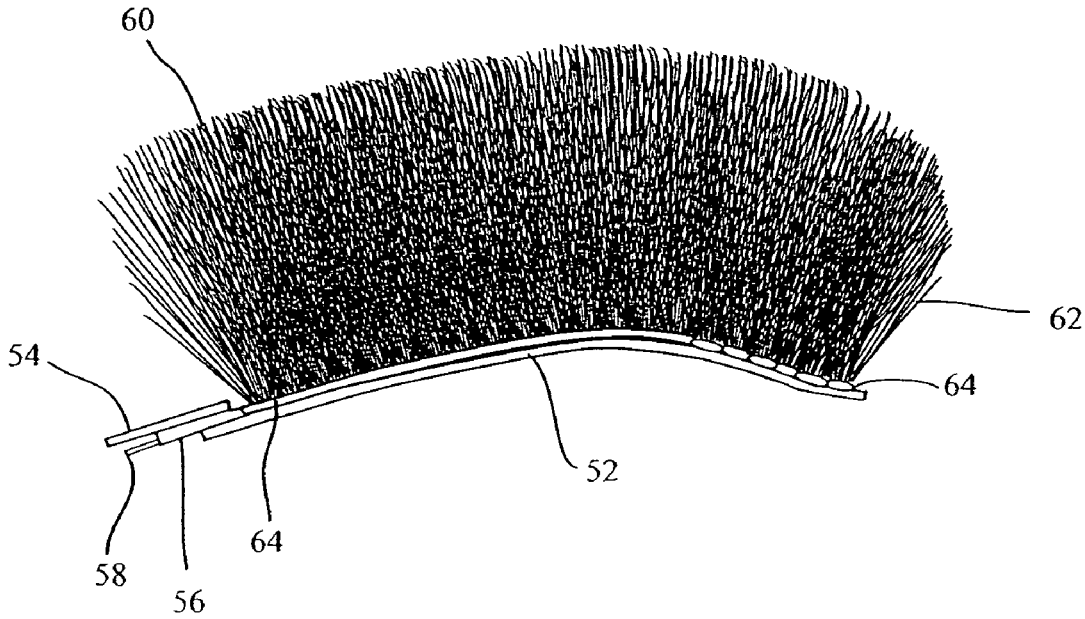
FIG. 6 is a side view of an assembled fur plate, wherein the plate is shown bent into the approximate shape following assembly on the hat and molding of the plates.

FIG. 1 shows a fine quality streimel fur hat 46 made of individual plates 40. Fine quality streimel fur hats typically will contain thirty or more fur plates, to provide a thick, dense fur covering for the hat sides. The fur plates are made of a plate backing material form 52, shown in FIG. 2. Split animal tails 60 and small fur pieces 62, as shown in FIG. 3, are attached to this form. The attachment process applies the small fur pieces in layers as shown in FIGS. 4 and 5. An assembled fur plate side view is shown in FIG. 6.

The plate backing material form 52 is made from a piece of flexible heat resistant plastic. The plastic is cut to form a tongue with two sides 51, 53, which form the long dimension, and opposite ends 55, 57, which form the short dimension. The distal end 55 is provided with rounded corners, and the proximal end 57 is attached to a ribbon 54, as shown in FIG. 2. When the plate is assembled on the hat, the sides 51, 53 will be horizontal, the distal end 55 will be on the periphery of the hat, and the proximal end 57 will be attached to the hat.

A plate stiffener pouch 56 is attached to the backing material on three sides as shown in FIG. 2, to become part of the form. The pouch is sized to receive a stiffener through the open side. The pouch is provided to stiffen the central portion of the backing material on the long axis of the backing material form, and it is centrally located between the left and right sides 51, 53. The pouch is made of a flexible, elastic material, plastic or leather, which is attached by sewing to provide a joint that will withstand the insertion and bending of the stiffener. The stiffener 58, shown inserted in the pouch in FIG. 6, is a long, thin piece of plastic material that may be mechanically deformed when heated, and that retains the deformed shape as it cools. Use of the stiffener provides a fur plate that may be molded into the desired shape after installation on the hat.

A ribbon 54 is sewn or glued to the proximal end 57 of the backing material 52. The ribbon 54 is a piece of fabric that is sewn to the ribbon on the adjacent plate to form an overlapping strip of plates 40. While shown without fur in FIG. 7 for clarity, the fur has in fact been attached prior to forming the strip. Alternately, the plate ribbons 54 may be sewn to a band of material 42 that, in applying the fur plates to a hat shell 44, has its two ends together to form the strip into a circle. This strip of overlapping plates 40 is attached to the crown of a hat shell 44 to form a completed hat 46, as depicted in FIG. 1.

The fur attached to the plate backing material form 52 is from a fur-bearing animal tail. The fur tail is prepared for installation by first cutting it lengthwise and flattening it. Depending on the size of the tail, it may be split into two additional halves as shown on FIG. 3. Small diameter tails would be split only once and the single split tail would approximate one-half of the two halves shown in FIG. 3. The two tail halves or split tails 60 are in the long dimension of the tail as shown. Split tails are then selected for use as whole split tails or for further processing into small fur pieces. Those with more uniform fur density will be selected for use as whole split tails. Tail halves to be processed into small fur pieces may then be softened by drawing the tail skin over the edge of a metal bar repeatedly until a satisfactory flexibility is obtained. Small fur pieces 62 are then taken from the split tail by cutting at an angle to the long dimension as shown in FIG. 3. These small pieces are bare on the bottom of the skin 64 and have fur on the top of skin 64 and are ready for assembly to the plate backing material form 52 shown in FIG. 2.

Fur is attached to the plate backing material form or tongue 52 on three sides as shown in FIG. 4. No fur is applied at the proximal end 57. Fur is applied first by using whole split tails 60 on the long dimension of the form as shown. Then the distal end of the form is filled in by applying small pieces one at a time. Glue is applied to the form in the location it is desired to apply the fur. Then the skin of the fur piece is placed in the glue to attach it to the form. This is repeated until the fur is in the desired array on the form. FIG. 4 shows a partial array of this first level of fur, wherein additional small pieces of fur are required to complete the first layer.

A second layer of small fur pieces is applied to the form adjacent to the first layer after the first layer glue dries, and this second layer is located towards the central portion of the form. The glue is allowed to dry again, and a third layer is applied to the central portion of the form, as shown in FIG. 5, to obtain the desired fur density and the appearance of uninterrupted fur. The fur may be combed during and after application to the form to obtain the desired orientation.

Figure 7:
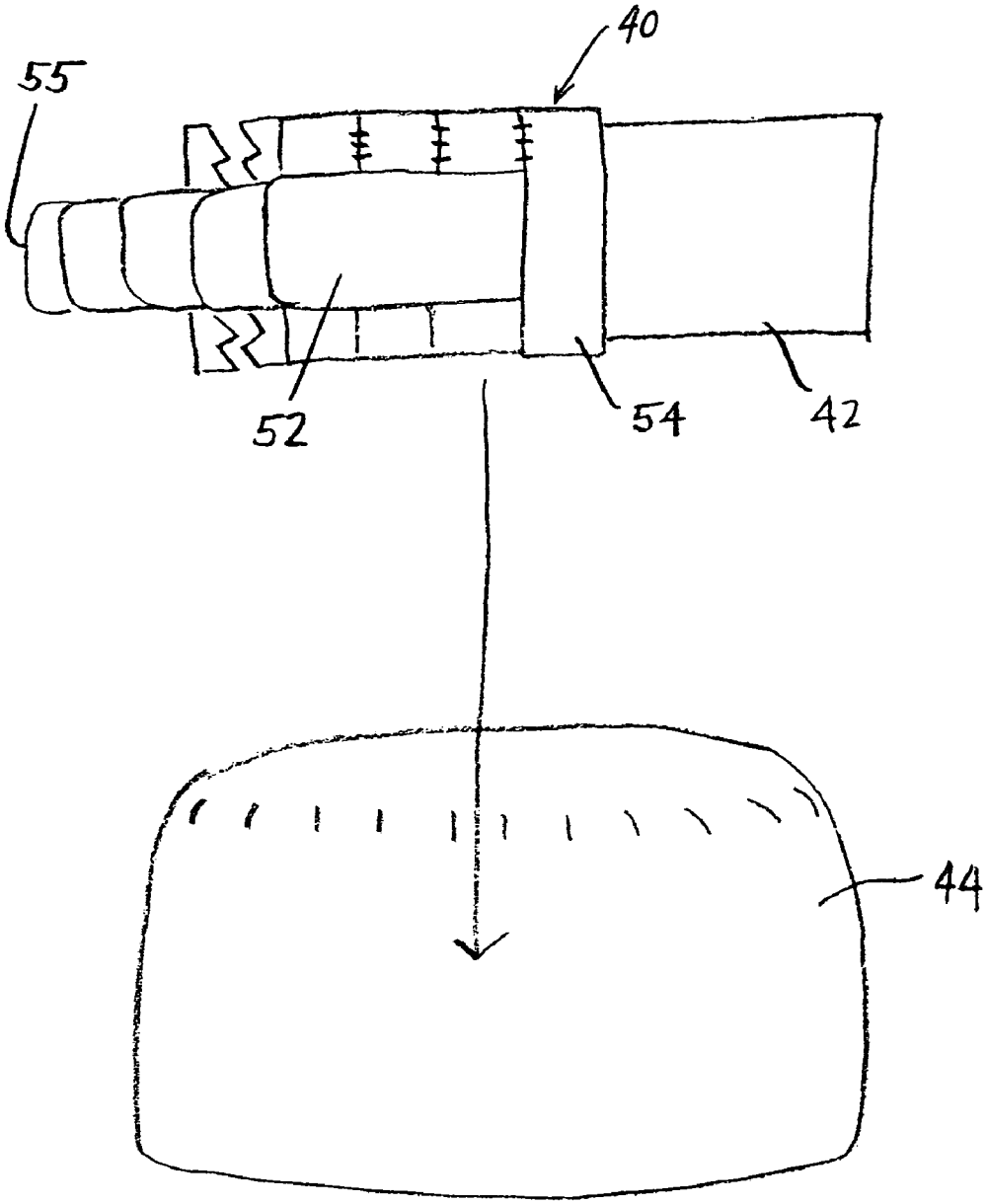
FIG. 7 is a perspective of a strip of plates prior to assembly to the crown of a hat shell.

The completed fur plates are attached to the hat crown in sequence around the circumference of a hat shell as depicted in FIG. 7. The plates on the assembled hat are bent into the desired shape by first heating in an oven, and then bending the individual plates by hand to obtain an overlap that provides the appearance of a continuous band of fur around the hat. FIG. 6 provides a side view of a completed fur plate that has been shaped. Multiple steps of heating and forming the plates may be used to obtain the desired hat configuration.

Persons skilled in the art will recognize the method of the present invention may be used in manufacturing other fur articles employing changes in the configuration of the materials. The application of the method to the hat described herein is not intended to limit the application of the invention to this hat, other than as described in the claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of making a fur plate for use in manufacturing a hat, said method comprising:

providing at least one elongate animal tail skin having fur;

cutting each said tail skin lengthwise to form a plurality of split tail pieces;

cutting at least one of said split tail pieces to form a plurality of short tail pieces;

providing a tongue of backing material having a pair of sides which form a long dimension, and a pair of ends which form a short dimension, said ends comprising a proximal end and a distal end;

attaching a split tail piece to said tongue along each one of said sides; and attaching a first layer of said short tail pieces to said tongue adjacent to said distal end.

2. The method of claim 1 further comprising attaching a ribbon of material to said proximal end.

3. The method of claim 1 further comprising attaching a second layer of short tail pieces to said tongue adjacent to said first layer.

4. The method of claim 3 further comprising attaching a third layer of short tail pieces to said tongue adjacent to said second layer.

5. The method of claim 1 wherein said tail pieces are attached to said tongue of backing material using adhesive.

6. The method of claim 5 wherein the adhesive is applied to said tongue, and the tail pieces are then applied to the adhesive.

7. The method of claim 1 wherein at least one of said tail skins is cut lengthwise more than once to form said split tail pieces.

8. The method of claim 1 wherein said at least one of said tail skins is cut a first time to form halves, and at least one of said halves is cut a second time to form said split tail pieces.

9. The method of claim 1 wherein said tongue is provided with rounded corners between said distal end and said sides.

10. A method of manufacturing a fur hat, the method comprising: providing a plurality of elongate animal tail skins having fur attached thereto;

cutting each said tail skin lengthwise to form a plurality of split tail pieces;

cutting at least one of said split tail pieces to form a plurality of short tail pieces;

providing a plurality of tongues of backing material, each tongue having a pair of sides which form a long dimension, and a pair of ends which form a short dimension, said ends comprising a proximal end and a distal end; attaching a split tail piece to each said tongue along each one of said sides;

attaching a first layer of said short tail pieces to each said tongue adjacent to said distal end;

providing a hat shell having a crown; and attaching said proximal ends of said tongues to said crown so that said tongues overlap and form a ring bounded by the fur on said sides.

11. The method of claim 10 further comprising attaching a ribbon of material to each said proximal end, and attaching said ribbons to said crown of said hat shell.

12. The method of claim 11, wherein the step of attaching said ribbons to said crown of said hat comprises:

attaching said ribbons to a band of material so that said tongues overlap; and attaching said band of material to said crown of said hat shell to form said ring.

13. The method of claim 10 further comprising:

attaching an elongate pouch to each said tongue centrally between said sides; and inserting a thermoplastic stiffener in each said pouch.

14. The method of claim 13 further comprising:

heating the hat so that the thermoplastic stiffeners become soft;

deforming the thermoplastic stiffeners to achieve a desired shape while the stiffeners are soft; and cooling the hat so that the stiffeners retain the desired shape.

15. The method of claim 13 wherein said pouch is closed toward said distal end.

16. The method of claim 10 further comprising attaching a second layer of short tail pieces to each said tongue adjacent to said first layer.

17. The method of claim 16 further comprising attaching a third layer of short tail pieces to each said tongue adjacent to said second layer.

18. The method of claim 10 wherein said tail pieces are attached to each said tongue of backing material using adhesive.

19. The method of claim 18 wherein the adhesive is applied to each said tongue, and the tail pieces are then applied to the adhesive.

20. The method of claim 10 wherein at least one of said tail skins is cut lengthwise more than once to form said split tail pieces.

21. The method of claim 10 wherein said tongue is provided with rounded corners between said distal end and said sides.

22. A fur plate comprising:

a tongue of backing material having a pair of sides which form a long dimension, and a pair of ends which form a short dimension, said ends comprising a proximal end and a distal end;

a split tail piece attached to said tongue along each one of said sides, each said split tail piece being formed by cutting lengthwise an elongate animal tail skin having fur; and a first layer of said short tail pieces attached to said tongue adjacent to said distal end, each said short tail piece being formed by cutting a split tail piece.

23. The fur plate of claim 22 further comprising a ribbon of material attached to said proximal end of said tongue.

24. The fur plate of claim 22 further comprising a second layer of short tail pieces attached to said tongue adjacent to said first layer.

25. The fur plate of claim 24 further comprising a third layer of short tail pieces attached to said tongue adjacent to said second layer.

26. The fur plate of claim 22 wherein said tail pieces are attached to said tongue of backing material using adhesive.

27. The fur plate of claim 22 further comprising:

an elongate pouch attached to said tongue centrally between said sides; and a thermoplastic stiffener in said pouch.

28. The fur plate of claim 27 wherein said pouch is closed toward said distal end.

29. The fur plate of claim 22 wherein said tongue has rounded corners between said distal end and said sides.

30. A fur hat comprising a hat shell having a crown and a plurality of fur plates, each said fur plate comprising:

a tongue of backing material having a pair of sides which form a long dimension, and a pair of ends which form a short dimension, said ends comprising a proximal end and a distal end;

a split tail piece attached to said tongue along each one of said sides, each said split tail piece being formed by cutting lengthwise an elongate animal tail skin having fur; and a first layer of said short tail pieces attached to said tongue adjacent to said distal end, each said short tail piece being formed by cutting a split tail piece; wherein said proximal ends of said tongues are attached to said crown so that said fur plates overlap and form a ring bounded by the fur on said sides.

31. The fur hat of claim 30 wherein each said fur plate comprises a ribbon of material attached to said proximal end of said ribbon, each said ribbon being attached to said crown.

32. The fur hat of claim 30 further comprising a band of material to which said ribbons are attached, said band of material being attached to said crown of said hat shell to form said ring.

33. The fur plate of claim 30 further comprising a second layer of short tail pieces attached to each said tongue adjacent to said first layer.

34. The fur plate of claim 33 further comprising a third layer of short tail pieces attached to each said tongue adjacent to said second layer.

35. The fur plate of claim 34 wherein said tail pieces are attached to said tongue of backing material using adhesive.

36. A fur hat as in claim 30 further comprising:

an elongate pouch attached to each said tongue centrally between said sides; and a thermoplastic stiffener in each said pouch, said stiffener being formed to a desired shape.

* * * * *